US006107266A

United States Patent [19]

Himmrich et al.

[11] Patent Number: 6,107,266

[45] **Date of Patent: *Aug. 22, 2000**

[54] PROCESS FOR PRODUCING COATED BLEACH ACTIVATOR GRANULES

[75] Inventors: Johannes Himmrich, Kirchen; Georg Borchers, Bad Nauheim, both of Germany

[73] Assignee: Clariant GmbH, Frankfurt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/939,170

[22] Filed: Oct. 7, 1997

[30] Foreign Application Priority Data

Oct. 10, 1996 [DE] Germany ..... 196 41 708

[51] Int. Cl.[7] ..... C11D 3/06; C11D 3/08; C11D 3/10; C11D 3/395

[52] U.S. Cl. ..... 510/349; 510/356; 510/358; 510/444; 510/445; 510/457; 252/186.25

[58] Field of Search ..... 510/312, 313, 510/349, 356, 445, 451, 376, 358, 444, 457; 252/186.25

[56] References Cited

U.S. PATENT DOCUMENTS

| | | | |
|---|---|---|---|
| 4,003,841 | 1/1977 | Hachmann et al. | 252/94 |
| 4,372,868 | 2/1983 | Saran et al. | 252/102 |
| 4,457,858 | 7/1984 | Saran et al. | 252/182 |
| 4,486,327 | 12/1984 | Murphy et al. | 252/94 |
| 4,678,594 | 7/1987 | Parfomak et al. | 252/186.31 |
| 4,695,397 | 9/1987 | Sommer et al. | 252/182 |
| 5,100,576 | 3/1992 | Cramer et al. | 252/186.25 |
| 5,167,852 | 12/1992 | Emery et al. | 252/95 |
| 5,230,822 | 7/1993 | Kamel et al. . | |
| 5,334,324 | 8/1994 | Zeise et al. | 252/91 |
| 5,458,801 | 10/1995 | Oyashiki et al. | 252/186.25 |
| 5,480,577 | 1/1996 | Nicholson et al. . | |
| 5,534,196 | 7/1996 | Chapman et al. | 252/186.27 |
| 5,716,569 | 2/1998 | Berenbold et al. | 264/115 |

FOREIGN PATENT DOCUMENTS

| | | |
|---|---|---|
| 037026 | 10/1981 | European Pat. Off. . |
| 0075818 | 4/1983 | European Pat. Off. . |
| 0325100 | 7/1989 | European Pat. Off. . |
| 0468824 | 1/1991 | European Pat. Off. . |
| 0492000 | 7/1992 | European Pat. Off. . |
| 0737739 A2 | 10/1996 | European Pat. Off. . |
| 4316481 A1 | 11/1994 | Germany . |
| 4439039 | 5/1996 | Germany . |
| WO 90/01535 | 2/1990 | WIPO . |
| WO 91/10719 | 7/1991 | WIPO . |
| WO 92/13798 | 8/1992 | WIPO . |
| WO 94/26826 | 11/1994 | WIPO . |
| WO 94/26862 | 11/1994 | WIPO . |

OTHER PUBLICATIONS

European Search Report.
Derwent Patent Family Report and/or Abstract.

*Primary Examiner*—Gregory N. Del Cotto
*Attorney, Agent, or Firm*—Miles Dearth

[57] ABSTRACT

The present invention relates to a process for producing coated bleach activator granules in which bleach activator base granules are coated with a coating substance and are simultaneously and/or subsequently thermally conditioned.

7 Claims, No Drawings

PROCESS FOR PRODUCING COATED BLEACH ACTIVATOR GRANULES

BACKGROUND OF THE INVENTION

Bleach activators are important ingredients in detergents, scouring salts and dishwashing agents. They permit a bleaching action even at relatively low temperatures in that they react with hydrogen peroxide—usually perborates or percarbonates—to release an organic peroxycarboxylic acid.

The bleaching result obtainable depends on the nature and reactivity of the peroxycarboxylic acid formed, on the structure of the bond that is to be perhydrolyzed and on the solubility of the bleach activator in water. Since the activator is usually a reactive ester or an amide, it is frequently necessary to use it in granulated form for the intended application in order to prevent hydrolysis in the presence of alkaline detergent ingredients and to ensure an adequate shelf life.

Numerous auxiliaries and processes have been proposed in the past for granulating these substances. EP-A-0 037 026 describes a process for producing readily soluble activator granules comprising 90 to 98% activator with 10 to 2% cellulose ethers, starch or starch ethers. Granules consisting of bleach activator, film-forming polymers and added organic $C_3$–$C_6$-carboxylic, hydroxycarboxylic or ether carboxylic acid are specified in WO 90/01535. EP-A-0 468 824 discloses granules comprising bleach activator and a film-forming polymer which is more soluble at a pH of 10 than at a pH of 7.DE-A-44 39 039 describes a process for producing activator granules by mixing a dry bleach activator with a dry, inorganic binder material containing water of hydration, compressing this mixture to form relatively large agglomerates, and comminuting these agglomerates to the desired grain size. A waterless production process, by compacting the bleach activator with at least one water-swellable auxiliary, without the use of water, is known from EP-A-0 075 818.

Disadvantages of these activator granules are that the properties of the granules are fixed essentially by the binder and by the granulating method used and that the resulting granules, besides the advantages described in the literature, often have certain disadvantages as well, for example sub-optimal release of active substance, low abrasion resistance, high dust content, inadequate shelf life, separation within the powder or damage to the color of the fabric when used in detergents and cleaning materials.

In order to give granules defined properties a coating step is often carried out subsequent to the granulating step. Common methods are coating in mixers (mechanically induced fluidized bed) or coating in fluidized-bed apparatus (pneumatically induced fluidized bed).

For instance, WO 92/13798 describes, for a bleach activator, coating with a water-soluble organic acid which melts at above 30° C., and WO 94/03305 describes coating with a water-soluble acidic polymer in order to reduce color damage to the laundry.

WO 94/26862 discloses the coating of granules consisting of bleach activator and a water- and/or alkali-soluble polymer with an organic compound melting at between 30 and 100° C. for reducing separation in the pulverulent end product. In this case the activator granules are placed in a L ödige plowshare mixer, circulated at from 160 to 180 rpm at room temperature, without using the pelletizer, and then sprayed with the hot melt. A disadvantage of this process is the very poor coating quality, which, although it brings about a reduction in separation in the pulverulent end product, has no effect on the other granule properties, such as release of active substance, abrasion resistance, dust content or shelf life, for example. The positive effect on the separation behavior can probably be attributed to a droplet-like solidification of the coating substance on the granule surface allowing the individual grains to hook together in the bulk product.

The object of the present invention was to develop a coating process for activator granules which makes it possible to tailor the granule properties within a wide range at the same time as making optimum use of the coating material.

This object was achieved by a thermal conditioning during and/or after coating.

SUMMARY OF THE INVENTION

The invention accordingly provides a process for producing coated bleach activator granules in which bleach activator base granules are coated with a coating substance and are simultaneously or subsequently thermally conditioned.

DESCRIPTION OF THE PREFERRED EMBODIMENTS

Base granules which can be used are all activators which in granulated form have a melting point of above 100° C. Examples of activator substances are tetraacetylethylenediamine (TAED), tetraacetylglycoluril (TAGU), diacetyldioxohexahydrotriazine (DADHT), acyloxybenzenesulfonates (e.g. nonanoyloxybenzenesulfonate [NOBS], benzoyloxybenzenesulfonate [BOBS]), acylated sugars (e.g. pentaacetylglucose [PAG]) or compounds as are described in EP-A-0 325 100, EP-A-0 492 000 and WO 91/10719. Other suitable activators are N-acylated amines, amides, lactams, activated carboxylic esters, carboxylic anhydrides, lactones, acylals, carboxamides, acyllactams, acylated ureas and oxamides, and, furthermore, especially nitriles, which in addition to the nitrile group may also contain a quaternized ammonium group. Mixtures of different bleach activators can also be present in the base granules.

These base granules can include the customary granulating auxiliaries, which should have a melting point of more than 100° C. Suitable such auxiliaries are film-forming polymers, for example cellulose ethers, starch, starch ethers, homopolymers, copolymers and graft copolymers of unsaturated carboxylic acids and/or sulfonic acids and also the salts thereof; organic substances, for example cellulose, crosslinked polyvinylpyrrolidone, or inorganic substances, for example silicic acid, amorphous silicates, zeolites, bentonites, alkali metal phyllosilicates of the formula $$MM'Si_xO_{2x-1} \cdot y\ H_2O\ (M, M'=Na, K, H;\ x=1.9–23;\ y=0–25),$$

orthophosphates, pyrophosphates and polyphosphates, phosphonic acids and their salts, sulfates, carbonates and bicarbonates. Depending on what is required these granulating auxiliaries can be employed as individual substances or as mixtures.

In addition to the bleach activator and the granulating auxiliary the bleach activator base granules may also include further additives which enhance properties such as, for example, shelf life and bleach activation. Such additives include inorganic acids, organic acids, for instance mono- or polybasic carboxylic acids, hydroxycarboxylic acids and/or ether carboxylic acids, and also salts thereof, complexing agents, metal complexes and ketones.

Depending on what is required, the abovementioned additives can be employed as individual substances or as mixtures.

The base granules are made by mixing a dry bleaching activator with a dry inorganic binder material, pressing this mixture to give relatively large agglomerates and comminution of these agglomerates to the desired particle size.

The ratio of bleaching activator to inorganic binder material is usually 50:50 to 98:2, preferably 70:30 to 96:4% by weight. The amount of additive depends in particular on its nature. Thus, acidifying additives and organic catalysts are added to increase the performance of the peracid in amounts of 0–20% by weight, in particular in amounts of 1–10% by weight, based on the total weight, while metal complexes are added in concentrations in the ppm range.

Suitable coating substances are all compounds or mixtures thereof which are solid at room temperature and which soften or melt in the range from 30 to 100° C. Examples of such are:

$C_8$–$C_{31}$ fatty acids (e.g. lauric, myristic, stearic acid); $C_8$–$C_{31}$ fatty alcohols; polyalkylene glycols (e.g. polyethylene glycols having a molar mass of from 1000 to 50,000 g/mol); nonionics (e.g. $C_8$–$C_{31}$ fatty alcohol polyalkoxylates with from 1 to 100 moles of EO); anionics (e.g. alkanesulfonates, alkylbenzenesulfonates, α-olefinsulfonates, alkyl sulfates, alkyl ether sulfates having $C_8$–$C_{31}$ hydrocarbon radicals); polymers (e.g. polyvinyl alcohols); waxes (e.g. montan waxes, paraffin waxes, ester waxes, polyolefin waxes); silicones.

Within the coating substance which softens or melts in the range from 30 to 100° C. there may additionally be other substances, not softening or melting in this temperature range, in dissolved or suspended form, examples being polymers (e.g. homopolymers, copolymers or graft copolymers of unsaturated carboxylic acids and/or sulfonic acids and alkali metal salts thereof, cellulose ethers, starch, starch ethers, polyvinylpyrrolidone); organic substances (e.g. mono- or polybasic carboxylic acids, hydroxycarboxylic acids or ether carboxylic acids having 3 to 8 C-atoms, and the salts thereof); colorants; inorganic substances (e.g. silicates, carbonates, bicarbonates, sulfates, phosphates, phosphonates).

Depending on the desired properties of the coated activator granules, the content of coating substance can be from 1 to 30% by weight, preferably from 5 to 15% by weight, based on coated activator granules.

The coating substances can be applied using mixers (mechanically induced fluidized bed) and fluidized-bed apparatus (pneumatically induced fluidized bed). Examples of possible mixers are plowshare mixers (continuous and batchwise), annular bed mixers or else Schugi mixers. If a mixer is used, the thermal conditioning can take place in a granule preheater and/or directly in the mixer and/or in a fluidized bed downstream of the mixer. The coated granules can be cooled using granule coolers or fluidized-bed coolers. In the case of fluidized-bed apparatus, the thermal conditioning takes place by way of the hot gas used for fluidizing. The granules coated by the fluidized-bed method, as with the mixer method, can be cooled by way of a granule cooler or a fluidized-bed cooler. In both the mixer method and the fluidized-bed method the coating substance can be sprayed on by way of a single-substance or dual-substance nozzle apparatus.

The thermal conditioning comprises a heat treatment at a temperature from 30 to 100° C. but no higher than the melting or softening temperature of the respective coating substance. It is preferred to operate at a temperature which lies just below the melting or softening temperature.

The grain size of the coated bleach activator granules is from 0.1 to 2.0 mm, preferably from 0.2 to 1.0 mm and, with particular preference, from 0.3 to 0.8 mm.

The precise temperature during thermal conditioning or the difference in temperature from the melting point of the coating substance is dependent on the amount of the coating material, on the thermal conditioning time and on the properties desired for the coated bleach activator granules, and must be determined in preliminary experiments for the particular system.

The period for thermal conditioning is from approximately 1 to 180, preferably from 3 to 60 and, with particular preference, from 5 to 30 minutes.

The advantage of the new process over the prior art is that the liquid coating material does not solidify too rapidly and thus has the possibility of running as a thin film over the surface of the granules. This produces a highly uniform coating of the grain in a thin layer with the coating substance, and an optimum coating effect for use of a minimum amount of coating substance. In conventional processes, i.e. those without a thermal conditioning step, solidification of the individual droplets on the cold granule surface is too rapid. Consequently, the surface is covered only with fine individual droplets and still has large coating voids. As a result, the desired coating effect is not fully obtained or a much higher amount of coating substance is required in order to obtain the desired coating effect. In the latter case, however, the content of activator substance is reduced, which in many cases is undesirable.

By means of the novel process it is possible to tailor the properties of the activator granules within broad ranges to the desired specifications by an appropriate choice of the coating substance, the coating rate and the process temperature regime. In this context it is possible in particular to optimize in a targeted manner the following activator granule properties.

1. Time-optimized release of active substance

In order to avoid interaction between the bleaching system and the enzyme system it is advantageous to couple a slightly delayed reaction and active-substance release of the bleaching system with rapid enzyme action. In this way the enzymes can develop their washing power fully within the first few minutes of the washing process without being damaged by the bleaching system. Only after the enzymes have done their job is the bleaching process set in motion by reaction of the bleach activator with the hydrogen peroxide source. Appropriate coating of the bleach activator makes it possible to tailor the reactivity, i.e. the rate of dissolution or the rate of formation of the peracid, specifically to the enzyme system. The process permits controlled adjustment of the rate of formation of the peracid at the same time as having a minimal amount of coating substance and thus the maximum activator content.

2. Increasing the abrasion resistance

By coating granules with softening or melting substances it is possible to increase the abrasion resistance of activator granules. The increase in abrasion resistance is greater the better the coating of the granule surface with the coating substance. The novel coating process makes it possible, with a minimum coating rate, to bring about optimum flow of the coating substance over the granule surface and thus an optimum enhancement of the abrasion resistance.

3. Reducing the dust content

The novel coating process, in which excessively rapid solidification of the softening or melting coating substance is prevented by means of appropriate thermal conditioning during and/or after the coating step also makes it possible for granules to be dedusted in an optimum manner with a minimal coating rate, since the coating substance remains flowable and bindable over a relatively long period and is thus able to bind more dust particles. With prior art coating, on the other hand, there may at worst even be an increase in the dust content as a result of in some cases direct spray drying.

4. Extending the shelf life

When a detergent and cleaning material is stored there may be a reaction at the boundary between activator grain and a directly adjacent grain of the hydrogen peroxide source, with subsequent loss of active oxygen and thus uncontrolled breakdown of the bleaching system. By means of optimum coating, as is possible only through the novel coating process, a complete protective layer is constructed at the grain boundary, which layer then prevents reaction of the activator grain with the grain of the hydrogen peroxide source in the course of storage. When water-soluble and/or low-melting coating substances are used it is nevertheless possible to obtain the required bleaching performance in the washing process.

The granules obtained in this way are directly suitable for use in detergents and cleaning materials. They are ideal for use in heavy-duty detergents, scouring salts, dishwashing agents, general purpose cleaning powders and denture cleansers. In such formulations the granules of the invention are employed usually in combination with a hydrogen peroxide source. Examples thereof are perborate monohydrate, perborate tetrahydrate, percarbonates, and adducts of hydrogen peroxide with urea or with amine oxides. The formuation may also feature further, prior art detergent ingredients, such as organic or inorganic builders and cobuilders, surfactants, enzymes, washing additives, fluorescent whiteners and fragrance. titrations. The maximum amount of peracetic acid found was then taken as being 100% and on this basis, finally, the amount of peracetic acid formed after 5, 10 and 20 minutes was determined in percent as a measure of the rate of formation of peracetic acid.

TABLE 1

Rate of formation of peracetic acid by the TAED granules coated in the Schugi mixer with downstream fluidized bed (products 1 and 4: comparison examples)

| Product | | Peracetic acid formed [%] | | |
|---|---|---|---|---|
| No. | TAED granules | 5 min | 10 min | 20 min |
| 1 | Base granules (BG, uncoated) | 75 | 95 | 100 |
| 2 | BG + 10% myristic acid, thermally conditioned | 11 | 21 | 55 |
| 3 | BG + 15% myristic acid, thermally conditioned | 9 | 18 | 54 |
| 4 | BG + 15% myristic acid, cooled | 39 | 59 | 83 |

By means of the thermal conditioning it is possible to bring about a marked improvement in the coating quality, expressed by the delay in the formation of peracetic acid, for the same coating rate (comparison of products 3 and 4).

To achieve an optimum coating quality an amount of 10% coating substance (product 2) is sufficient given appropriate thermal conditioning.

EXAMPLES

Example 1

Coating in a Schugi mixer with downstream fluidized bed for thermal conditioning and cooling TAED 4303 (Hoechst AG) was metered continuously at a throughput of 480 kg/h into a Schugi mixer (Flexomix 160, from Hosokawa Schugi) and sprayed with a hot (75° C.) melt of myristic acid. The coated material fell directly into a downstream fluidized bed (Hosokawa Schugi) where it was thermally conditioned at fluidized-bed temperatures of about 54° C. in a first chamber for 5 to 10 minutes and then was cooled at fluidized-bed temperatures of about 35° C. in a second chamber. For comparison purposes (prior art) TAED 4303 was metered continuously at a throughput of 480 kg/h into the Schugi mixer, sprayed with a hot (75° C.) melt of myristic acid and then cooled directly in a downstream fluidized bed at fluidized-bed temperatures of about 35° C.

The coating quality of the products was assessed by determining the rate of formation of peracetic acid at a temperature of 20° C. The slower the formation of peracetic acid the better the degree of coating achieved.

In order to determine the rate of formation of peracetic acid, 1 l of distilled water, 8.0 g of test detergent WMP and 1.5 g of sodium perborate monohydrate were placed in a 2 l glass beaker and the mixture was stirred at from 250 to 280 rpm using a magnetic stirrer. Then, after 1 to 2 minutes, 0.5 g of the coated TAED granules was added. After one minute an aliquot of 50 ml was removed by pipette and introduced onto 150 g of ice and 5 ml of 20% strength acetic acid in an Erlenmeyer flask. Immediately following the addition of 2 to 3 ml of 10% strength potassium iodide solution, the sample was titrated to the potentiometric endpoint with 0.01 molar sodium thiosulfate solution (Titroprocessor 716 DMS from Metrohm) and the amount of peracetic acid was calculated from the amount of sodium thiosulfate consumed. Then further samples were taken at intervals of 2 to 5 minutes and were titrated as described. The entire procedure was repeated until equal or descending amounts of peracetic acid were found after three successive

Example 2

Coating by the fluidized-bed method with downstream thermal conditioning

500–600 g of TAED 4303 were placed in a fluidized bed (fluidized-bed apparatus Strea 1 from Aeromatic) and sprayed with a hot (about 80° C.) melt of stearic acid. For comparison purposes, in one case the fluidized bed was operated at low temperatures and after the end of spraying was cooled again for about 5 minutes (prior art). In the other case, in accordance with the novel process, the coated granules were placed back in the fluidized bed and subjected to thermal conditioning. To this end the fluidized bed was heated gradually to temperatures of about 65 to 70° C. and this product temperature was held constant for about 5 to 8 minutes. The thermally conditioned product was then cooled down again in stages.

The coating quality was again examined by determining the rate of formation of peracetic acid at a temperature of 20° C. The slower the formation of peracetic acid the better the degree of coating achieved.

TABLE 2

Rate of formation of peracetic acid of TAED granules coated by the fluidized-bed method with subsequent thermal conditioning (products 5, 8 to 10: comparison examples)

| Product | | Peracetic acid formed [%] | | |
|---|---|---|---|---|
| No. | TAED granules | 5 min | 10 min | 20 min |
| 5 | Base granules (BG) | 75 | 95 | 100 |
| 6 | BG + 10% stearic acid, thermally conditioned | 10 | 21 | 50 |
| 7 | BG + 20% stearic acid, thermally conditioned | 12 | 22 | 52 |
| 8 | BG + 10% stearic acid, not thermally conditioned | 70 | 85 | 98 |
| 9 | BG + 20% stearic acid, not thermally conditioned | 40 | 60 | 84 |
| 10 | BG + 30% stearic acid, not thermally conditioned | 20 | 35 | 60 |

The thermal conditioning makes it possible to bring about a marked improvement in the coating quality, expressed by the delay in the formation of peracetic acid, for the same coating rate (comparison of products 6 and 8 and products 7 and 9, respectively).

To achieve an optimum coating quality an amount of 10% coating substance (product 6) is sufficient given appropriate thermal conditioning.

The influence of thermal conditioning on coating quality is also evident in the shelf life of TAED granules in detergent formulations.

The shelf life was tested in ready made-up folding boxes (height: 6.5 cm; width 3.2 cm; depth 2.2 cm) at 38° C. and 80% relative atmospheric humidity (rH) over a period of 28 days. Each folding box was filled with a homogeneous mixture comprising 8.0 g of test detergent WMP, 1.5 g of sodium percarbonate and 0.5 g of the test TAED granules and then was sealed at the top with Tesafilm adhesive tape. All samples were mixed and dispensed into the boxes on the same day. The filled and labeled folding boxes were then placed at a sufficient distance from one another in the climatically controlled cabinet and stored at 38° C./80% rH. After storage periods of 0, 3, 6, 9, 15, 23 and 28 days the samples were removed from the cabinet, the entire sample was introduced at 20° C. into 1 l of distilled water, while stirring with a magnetic stirrer (250 to 280 rpm), and 1 g of sodium percarbonate was added. Subsequent determination of the amount of peracetic acid formed was as indicated in Example 1. The TAED content of the sample was then calculated from the maximum value of peracetic acid found. The TAED durability represents the percentage TAED content of the sample after storage relative to the TAED content of the unstored sample.

TABLE 3

Shelf life in detergent formulations of TAED granules coated by the fluidized-bed method with subsequent thermal conditioning

| Product | | TAED durability after storage [%] | | | | | | |
|---|---|---|---|---|---|---|---|---|
| No. | TAED granules | 0 d | 3 d | 6 d | 9 d | 15 d | 23 d | 28 d |
| 5 | Base granules (BG) | 100 | 24 | 14 | 12 | 10 | 9 | 8 |
| 6 | BG + 10% stearic acid, thermally conditioned | 100 | 88 | 61 | 56 | 47 | 45 | 45 |
| 8 | BG + 10% stearic acid, not thermally conditioned | 100 | 52 | 24 | 20 | 18 | 16 | 15 |

With small coating quantities of from 5 to 10% an improvement in numerous product properties, for example the shelf life in detergent formulations, can be achieved only by thermal conditioning, i.e. only by the novel process.

Example 3

Coating by the fluidized-bed method with simultaneous thermal conditioning

TAED 4303 was metered continuously at 40 kg/h into the fluidized-bed apparatus (pilot plant fluidized-bed apparatus) by way of a flexible metering screw and was coated with 20% myristic acid. The residence time in the fluidized bed was about 30 minutes. The product, discharged through a star wheel sluice, was transported by means of a metering screw onto a screening machine on which the coarse fraction, larger than 1.0 mm, and the fine fraction, less than 0.2 mm, were separated off. The coarse fraction was subsequently comminuted in a mill and then passed together with the fine fraction via a flexible metering screw into the fluidized-bed apparatus. In the course of the experiment the fluidized-bed temperature was raised from an initial 46° C. to an ultimate 54° C.

The coating quality was examined by determining the rate of formation of peracetic acid at a temperature of 20° C. and by determining the content of dust smaller than 0.2 mm of the coated TAED granules. The slower the formation of peracetic acid the better the degree of coating achieved. The lower the dust content the better the dedusting achieved by the coating and the better the increase in abrasion resistance.

TABLE 4

Rate of formation of peracetic acid of TAED granules coated by the fluidized-bed method with simultaneous thermal conditioning (product 11: comparison example)

| Product | | $T_{fluid. bed}$ | Peracetic acid [%] | | | Dust content |
|---|---|---|---|---|---|---|
| No. | TAED granules | [° C.] | 5 min | 10 min | 20 min | [%] |
| 11 | Base granules (BG) | — | 75 | 95 | 100 | — |
| 12 | BG + 20% myristic acid | 46 | 66 | 81 | 94 | 30 |
| 13 | BG + 20% myristic acid | 49 | 48 | 68 | 87 | 15 |
| 14 | BG + 20% myristic acid | 52 | 38 | 60 | 86 | 10 |
| 15 | BG + 20% myristic acid | 54 | 20 | 36 | 62 | 5 |

As the fluidized-bed temperature increases and comes nearer to the melting point of myristic acid (55° C.) there is a marked increase in the coating quality, expressed by the delay in the formation of the peracid, and better dedusting and higher abrasion resistance are obtained, expressed by the falling content of dust <0.2 mm in the coated granules.

Example 4

Coating in a plowshare mixer with simultaneous thermal conditioning 1.2 kg of TAED granules in accordance with EP-A-0 037 026 were placed in a batch plowshare mixer (M5R from L ödige) and, while being thoroughly mixed with a mixing element rotational speed of around 150 rpm, were sprayed with 210 g of a hot (80° C.) melt of stearic acid. During the coating step the contents of the mixture were conditioned at a temperature of 50° C. by way of a heating jacket. The coating and thermal conditioning time was about 10 minutes. For comparison purposes, in accordance with WO 94/26826, 1.2 kg of TAED granules according to EP-A-0 037 026 were placed in a batch plowshare mixture and sprayed at room temperature, while being thoroughly mixed at a mixing element rotational speed of about 150 rpm, with 210 g of a hot (80° C.) melt of stearic acid.

The coating quality was examined by determining the rate of formation of peracetic acid at a temperature of 20° C.

TABLE 5

Rate of formation of peracetic acid by TAED granules coated in a plowshare mixer with thermal conditioning during the coating step (products 16 and 18; comparison examples)

| Product | | Peracetic acid [%] | | |
|---|---|---|---|---|
| No. | TAED granules | 5 min | 10 min | 20 min |
| 16 | Base granules | 81 | 96 | 100 |
| 17 | BG + 15% stearic acid, thermally conditioned (50° C.) | 44 | 61 | 79 |
| 18 | BG + 15% stearic acid, not thermally conditioned | 75 | 90 | 98 |

Without thermal conditioning, although it is possible by virtue of the coating to exert a positive influence on the separation behaviour (product 18), the improvement of many other properties, for example the delay in the formation of peracetic acid, is possible only by thermal conditioning, i.e. by the novel process (product 17).

The positive effect on the separation behavior which is obtained by the coating without thermal conditioning can probably be attributed to the droplet-like solidification of the coating substance on the granule surface, allowing the individual granules to hook together in the bulk product. However, this is not associated with any positive effect on many other properties.

Example 5

Coating in a plowshare mixer with simultaneous thermal conditioning

TAED 4303 was metered continuously at throughputs of from 100 to 300 kg/h into the plowshare mixer (KT-160 from Drais). At the same time the contents of the mixture were conditioned to temperatures in the range from 44 to 52° C. by way of a heating jacket. The residence time in the mixer was 8 to 12 minutes. Simultaneously, a melt of stearic acid at a temperature of 80° C. was sprayed through a nozzle into the front part of the mixer (nearer to the point of product entry). The coating rate was 7%. The mixer was operated at a mixing element rotational speed of 90 rpm and without deploying the pelletizing blades. The mixer was filled to a level where the product just covered the mixing shaft. The coated material was taken off continuously from the mixer and passed quickly through a screen (0.2 to 1.0 mm) in order to separate off fine and coarse fractions.

The coating quality was examined by determining the rate of formation of peracetic acid at a temperature of 20° C.

TABLE 6

Rate of formation of peracetic acid by TAED granules coated in a plowshare mixer with simultaneous thermal conditioning (product 19: comparison example)

| Prod. No. | TAED granules | $T_{mixture}$ [° C.] | Peracetic acid [%] 5 min | 10 min | 20 min |
|---|---|---|---|---|---|
| 19 | Base granules | — | 75 | 95 | 100 |
| 20 | BG + 7% stearic acid | 44 | 72 | 95 | 99 |
| 21 | BG + 7% stearic acid | 48 | 70 | 90 | 98 |
| 22 | BG + 7% stearic acid | 52 | 60 | 80 | 94 |

As the temperature of the mixture increases and comes nearer to the melting point of stearic acid there is an increase in the coating quality, expressed by the delay in the formation of the peracid.

What is claimed is:

1. A process for producing coated bleach activator granules, which consists of:

forming a mixture consisting of at least one dry bleach activator and at least one granulating auxiliary selected from the group consisting of cellulose ethers, starch, starch ethers, homopolymers, copolymers and graft copolymers of unsaturated carboxylic acids and/or sulfonic acids and the salts thereof, crosslinked polyvinylpyrrolidone, silicic acid, amorphous silicates, zeolites, bentonites, alkali metal phyllosilicates of the formula $$MM'Si_xO_{2x-1}*yH2O$$

wherein M or M' is Na, K or H; x is 1.9 to 23; and y is 0 to 25; orthophosphates, pyrophosphates, polyphosphates, phosphonic acids and their salts, carbonates, and bicarbonates pressing said mixture into agglomerates, comminuting said agglomerates to form bleach activator base granules, and coating said bleach activator base granules with from 5 to 15% by weight of a coating substance having a softening or melting point of from 30° C. to 100° C. said coating substance is selected from the group consisting of $C_8$–$C_{31}$ fatty acids, $C_8$–$C_{31}$ fatty alcohols, polyalkylene glycols, nonionic surfactants and anionic surfactants, and after said coating step thermally conditioning the coated granules by heat treating in a fluidized bed for 5 to 180 minutes at a temperature of 30° C. to 100° C. wherein the temperature remains constant during said heat treating, but said heat treating temperature is not higher than the melting or softening point of said coating substance, thereby forming a uniform, thin coating on said base granules.

2. The process as claimed in claim 1, wherein the activator base granules have a melting point of above 100° C.

3. The process as claimed claim 1, wherein the at least one dry bleach activator is selected from the group consisting of N-acylated amines, amides, lactams, acyloxybenzenesulfonates, acylated sugars, activated carboxylic esters, carboxylic anhydrides, lactones, acylals, oxamides and nitriles which may contain a quaternary ammonium group.

4. The process as claimed in claim 1, wherein the coating substance is applied in a mixer or in a fluidized-bed apparatus.

5. The process as claimed in one or more of claim 1, wherein the coated bleach activator granules have a grain size from 0.1 to 2.0 mm.

6. The process of claim 5 wherein said grain size is 0.2 to 1.0 mm.

7. The process of claim 6 wherein said grain size is 0.3 to 0.8 mm.

* * * * *